United States Patent [19]

Horikoshi et al.

[11] 4,178,896

[45] Dec. 18, 1979

[54] EXHAUST GAS RECYCLING SYSTEM

[75] Inventors: Masafumi Horikoshi, Toyota; Hidetaka Nohira, Mishima; Masaaki Tanaka, Susono, all of Japan

[73] Assignee: Toyota Jidosha Kogyo Kabushiki Kaisha, Toyota, Japan

[21] Appl. No.: 961,119

[22] Filed: Nov. 16, 1978

Related U.S. Application Data

[63] Continuation of Ser. No. 757,834, Jan. 10, 1977, abandoned.

[30] Foreign Application Priority Data

Sep. 10, 1976 [JP] Japan ..... 51-109098

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,756,210 | 9/1973 | Kuehl | 123/119 A |
| 3,799,131 | 3/1974 | Bolton | 123/119 A |
| 3,802,402 | 4/1974 | Swatman | 123/119 A |
| 3,834,366 | 9/1974 | Kingsbury | 123/119 A |
| 3,926,161 | 12/1975 | Wertheimer | 123/119 A |
| 3,931,813 | 1/1976 | Horie | 123/119 A |
| 4,041,917 | 8/1977 | Suzuki | 123/119 A |
| 4,124,004 | 11/1978 | Aoyama | 123/119 A |

*Primary Examiner*—Wendell E. Burns
*Attorney, Agent, or Firm*—Koda and Androlia

[57] ABSTRACT

Controlled exhaust gas recycling can be accomplished by a pneumatically actuated valve which restricts the flow of exhaust gas from an exhaust manifold of an internal combustion engine to the intake manifold. Exhaust gas may be removed from the manifold and enters a pressure chamber through a reduction means, such as an aperture in a plate. The effective cross-sectional area of hydrodynamic flow of the reduction means is chosen to be greater than the effective cross-sectional area of hydrodynamic flow of the valve. The valve is actuated by a diaphragm control means which is coupled to the intake and exhaust manifold. The diaphragm control means controls the amount of partial pressure applied to the pneumatically actuated valve according to the exhaust pressure from the exhaust manifold. Thus, the ratio of exhaust gas recycled through the internal combustion engine relative to the amount of engine air intake, decreases as the air intake volume increases, such as when the engine is under high loads or operating at high rates (RPM).

10 Claims, 4 Drawing Figures

EXHAUST GAS RECYCLING SYSTEM

This is a continuation of application Ser. No. 757,834, now abandoned, filed Jan. 10, 1977.

BACKGROUND OF THE INVENTION

I. Field of the Invention

The present invention relates to the field of exhaust gas recycling systems for use in combination with internal combustion engine.

II. Description of the Prior Art

Conventional pressure control exhaust gas recycling systems typically include a valve for regulating the amount of exhaust gas recycled (hereinafter sometimes referred to as EGR) and a pneumatically actuated control means coupled to the intake manifold in order to actuate the valve mechanism in response to the partial pressures developed within the intake manifold. By such conventional prior art apparatus the amount of exhaust gas recycled (EGR) is generally directly proportional to the amount of engine air intake. Therefore, the ratio of EGR to air intake has been substantially level under all running conditions of the engine.

However, since an internal combustion engine typically generates a high power output when the amount of air intake is large, such as under heavy loads or high RPM operations, it is necessary, in order to achieve fuel economy and to observe the limited heat resistance of typical EGR control parts, to reduce the EGR ratio to zero or at least a substantially low volume whenever the amount of air intake is large. Clearly, in the conventional exhaust gas recycling system, where the amount of exhaust gas recycled is proportional to the amount of air intake, such conventional systems have been unable to respond to this desired fashion. In fact, the EGR ratio of such conventional systems is usually dependently fixed on the running conditions of the engine.

What is needed then is an exhaust gas recycling system for internal combustion engines which improves performance, decreases fuel costs, and protects EGR control parts by reducing the EGR ratio whenever the amount of engine air intake exceeds a predetermined level.

BRIEF SUMMARY OF THE INVENTION

The present invention is an exhaust gas recycling system combined with an internal combustion engine which has an intake and exhaust manifold. The invention comprises an exhaust regulating means coupled to the intake and exhaust manifold. The exhaust regulating means is for restricting the amount of exhaust gas recycled from exhaust manifold to the intake manifold to reduce the EGR intake gas ratio above a predetermined magnitude of the intake gas. The exhaust regulating means includes a valve means for restricting the amount of recycled exhaust gas returned to the intake manifold whenever the air intake of the internal combustion engine increases above the predetermined magnitude. A diaphragm control means is coupled to the exhaust regulating means and communicates with at least one of the intake and exhaust manifolds for the purpose of controlling the exhaust regulating means.

The operation of the present invention may be briefly summarized as a method for controlling the recycling of exhaust gas through an internal combustion engine having an intake and exhaust manifold. The method comprises the steps of controlling the exhaust regulating means by the diaphragm control means which communicates with at least one of the intake and exhaust manifolds. The diaphragm control means generates a pneumatic control signal which is coupled to the exhaust regulating means. The flow of recycled exhaust gas is restricted from the exhaust manifold through the exhaust regulating means to the intake manifold in response to the pneumatic control signal from the diaphragm control means. The flow of exhaust gas in the exhaust regulating means is restricted by a valve means and a pressure chamber communicating with the exhaust manifold through a first reduction means. The first reduction means restricts the flow of exhaust gas therethrough from the exhaust manifold by restricting the effective area of hydrodynamic flow through the first reduction means to a first magnitude. The first valve means communicates with the pressure chamber and is used to restrict the flow of exhaust gas therethrough to the intake manifold by restricting the effective area of hydrodynamic flow through the first valve means to a second magnitude. The second magnitude has a maximum which is less than the first magnitude. As a result, the EGR ratio decreases when the air intake volume exceeds a predetermined magnitude. The present invention would be better understood by reviewing the following detailed description in connection with the drawings.

DETAILED DESCRIPTION OF THE PREFERRED EMBODIMENTS

The present invention is an exhaust gas recycling system combined with an internal combustion engine for the purpose of exhaust gas recycling (hereinafter EGR) in a proportionate manner with respect to air intake volume until a predetermined air intake volume is achieved and thereafter the ratio of EGR to air intake volume decreases. The present invention includes an exhaust or EGR regulating means 6 and a diaphragm control means 16. The diaphragm control means 16 generates a pneumatic control signal which is coupled to exhaust regulating means 6 to increase the amount of EGR in a generally proportional manner with respect to the volume of air intake. However, when a predetermined level of air intake is achieved, the amount of EGR is limited and the ratio of EGR to intake air volume decreases by virtue of the action of a reduction means and valve within the exhaust regulating means as discussed below. Effective area of hydrodynamic flow of the reduction means is greater than the maximum effective area of hydrodynamic flow of the valve.

Figure 1:
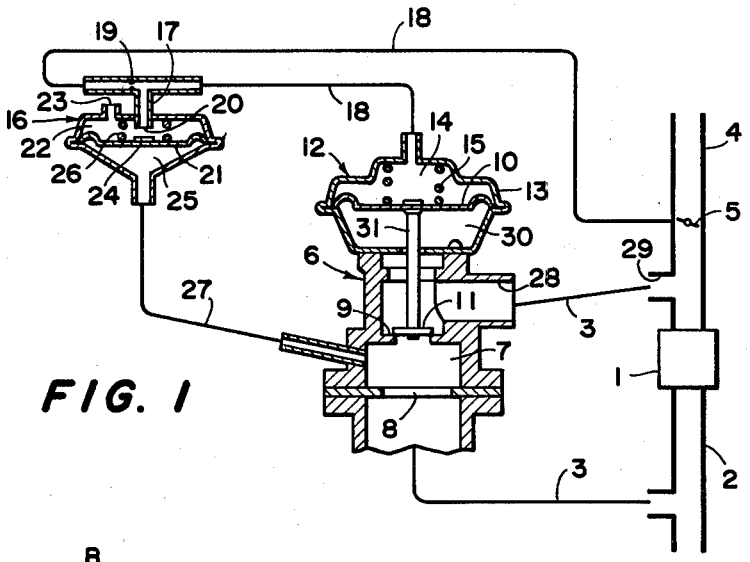
FIG. 1 is a simplified schematic of one embodiment of the present invention combined with an internal combustion engine.

Further embodiments of the present invention and its operation may be better understood by reviewing FIG. 1. FIG. 1 shows a cross-section including a diagrammatic view of the present invention as combined with an internal combustion engine 1 having an intake manifold 4 and an exhaust manifold 2. Exhaust regulating means 6 is coupled to exhaust manifold 2 by passage means 3. Passage means 3 may be any means for conducting a fluid under pressure well known to the art, such as tubing, hosing, or special modifications or extensions of the manifold itself. Exhaust regulating means 6 is also coupled to air intake manifold 4 at a point downstream from main throttle 5. Finally, exhaust regulating means 6 may be coupled to a reduction means 19 which in turn is coupled to air intake manifold 4 at, or at a point immediately downstream from throttle valve 5.

Figure 2:
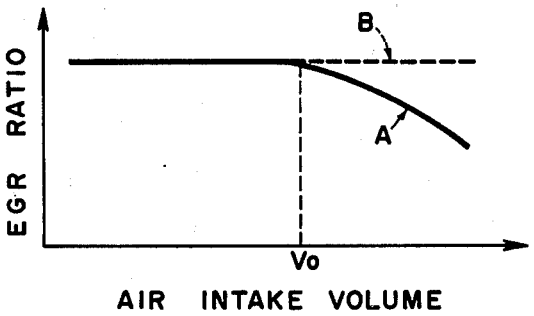
FIG. 2 is a graph illustrating the relationship between the volume of engine air intake and the EGR ratio as compared between conventional prior systems and the present invention as shown in the embodiment of FIG. 1.

Exhaust regulating means 6 includes a diaphragm mechanism 12, a valve 11, valve seat 9, pressure chamber 7 and a reduction means 8. Reduction means 8 includes any device well known to the art used for reducing or defining the effective hydrodynamic area of flow at a given point. For example, in its simplest form reduction means 8, includes, as shown in FIG. 2, a plate having an aperture defined therein. It is to be understood, of course, that the hydrodynamic flow in question is the flow of compressible fluids, namely exhaust gas or gases from exhaust manifold 2 which are communicated to chamber 7 though reductions means 8 by passage means 12. Valve seat 9 defines an opening in the wall of pressure chamber 7 opposite reduction means 8. Valve 11 engages valve seat 9 and thereby restricts the effective area of hydrodynamic flow, whether volume of mass flow, according to the separation of valve 11 from valve seat 9. Exhaust gases escaping from pressure chamber 7 through valve seat 9 and past valve 11 exit from a port 28 and are communicated by passage means 3 to a port 29 which is located a preselected position of intake manifold 4 downstream from main throttle 5. The exact positioning of port 29 with respect to main throttle 5 is a matter of design choice which may be chosen according to well known principles within each application.

Valve 11 is coupled to diaphragm mechanism 12 which includes a master chamber 4, a slave chamber 30 and a diaphragm member 10. As shown in FIG. 1 valve 11 is coupled to diaphragm 10 by a simple mechanical connection consisting of rod 31 extending through slave chamber 30 and fixedly secured to diaphragm 10. Master chamber 14 may include a spring means 15 for urging diaphragm 10 to a static position in which valve 11 engages valve seat 9. In addition, the degree of opening of valve 11 with respect to valve seat 9 will depend upon the partial vacuum formed within master chamber 14 as well as the spring constant of spring means 15. Typically, spring 15 is a coil compression spring well known to the art.

Exhaust regulating means 6 is coupled to diaphragm control means 16. Diaphragm control means 16 may include any means well known to the art for generating a pneumatic signal and in particular may be a simple diaphragm mechanism similar to that within exhaust regulating means 6. Diaphragm control means 16, for example, may include a master chamber 25, a slave chamber 22, a valve means 24, spring means 26, and a diaphragm member 21.

Master chamber 25 is communicated by passage means 27 with pressure chamber 7. Passage means 27 includes means well-known to the art for conveying fluids under pressure or partial pressures. Slave chamber 22 is vented to atmospheric pressure by means of a vent port 23. Spring means 26 typically a compression coil spring, merges diaphragm member 21 into a static position in which valve means 24 is in a maximum opened state. Valve means 24 for the sake of simplicity is shown as a valve and a mating valve seat 20, which may merely be the end of a bleed passage 17 communicating with reduction means 19. Reduction means 19 may be any means well known to the art for restricting the flow of fluid to a predetermined rate. In the present example reduction means 19 and bleed passage 17 is simply a "T" fitting having a diameter small enough to restrict the flow of air therethrough to preselected range of flow rates which may be determined by design choice according to well known principles. Reduction means 19 is coupled to air intake manifold 4 by passage means 18 at a point at or immediately downstream from main throttle valve 5.

The operation of the overall system and the functional relationship of the various elements of the present invention as described above may now be understood as follows. When internal combustion engine 1 is running, exhaust gas is admitted into pressure chamber 7 from exhaust manifold 2 by passage means 3 through reduction means 8. Pressure built up within pressure chamber 7 is similarly communicated by passage means 27 to master chamber 25 of diaphragm control means 16. When the pressure of exhaust gas within master chamber 25 exceeds a predetermined level, as determined by the design of the diaphragm mechanism as well as the spring constant of spring means 26, shown in FIG. 2 thereby tending to close valve means 24 against valve seat 20 and to restrict or close the passage of air through vent port 23 into bleed passage 17. When bleed passage 17 is completely closed, the vacuum or partial pressure coupled from air intake manifold 4 by passage means 18 to reduction means 19 is further communicated by a passage means 18 to master chamber 14 of diaphragm mechanism 12. Thus, when valve means 24 is completely seated against valve seat 20, the entire partial pressure of air intake manifold 4 is transmitted to master chamber 14.

When the vacuum of partial pressure inside master chamber 14 is sufficiently great, diaphragm member 10 is pulled upward against spring means 15 such that valve 11 disengages from valve seat 9. As valve 11 disengages from valve seat 9, exhaust gas enters pressure chamber 7 is allowed flow past the valve through port 28 to port 29 on air intake manifold 4. Thus, exhaust gas is recycled in this manner in proportion to the partial pressure within air intake manifold 4. After valve means 24 is completely closed against valve seat 20 the degree to which valve 11 is disengaged from valve seat 9 will be directly responsive to the partial pressure communicated to master chamber 14 from air intake manifold 4. As valve 11 disengages from valve seat 9 the effective cross sectional area of hydrodynamic flow between valve 11 and valve seat 9 increases. The volume or mass of exhaust gas which is recycled is proportional to the hydrodynamic area flow between valve 11 and valve seat 9. Valve 11 is controlled by the vacuum or partial pressure transmitted by passage means 18. The vacuum transmitted by passage means 18 is in turn controlled by the absolute value of partial pressure inside air intake manifold 4 and by the opening of closing of valve seat 20 in bleed passage 17. The opening and closing of port 20 in bleed passage 17 is further controlled by diaphragm member 21 which moves in response to the pressure of exhaust gas within master chamber 25. Typically, exhaust gas is created at a greater rate and pressure as the volume of air intake within air intake manifold 4 increases. Thus, to a degree, the greater the pressure of exhaust gas, the wider that valve 11 of exhaust regulating means 6 will be opened.

Accordingly, in a first range the amount of EGR is generally proportional to the amount of air intake of internal combustion engine 1 as a result of the operation of exhaust gas regulating means 6 and diaphragm control means 16. Thus, in a certain operating range the ratio of EGR to air intake volume is generally fixed. However, since the cross sectional hydrodynamic area of flow of reduction means 8 within exhaust regulating means 6 is greater than the maximum of the effective hydrodynamic flow between valve 11 and valve seat 9, the volume of exhaust gas flowing into pressure chamber 7 through reduction means 8 is greater than the volume of gas flowing past valve 11 and valve seat 9. At this point, the amount of EGR is then no longer controlled by valve 11 and cannot increase beyond a predetermined magnitude.

Finally, it should be noted that in the embodiment of the present invention the restoration of pressure to pressure chamber 7 is rapid. In other words, a momentary decrease in pressure in pressure chamber 7 results in an appropriate response in valve means 24 thereby permitting additional atmospheric pressure to be bled into master chamber 14. This in turn will tend to close valve 11 and to restore pressure in chamber 7 to its initial valve. Similarly, the increase in pressure is communicated to master chamber 25 and the amount of atmospheric pressure bled into master chamber 14 is decreased. In this manner, the pressure in master chamber 25 of diaphragm control means 16 is substantially stabilized. Accordingly, the period of oscillation of valve 11 against the valve seat 9 in exhaust regulating means 6 is substantially lengthened thereby improving vehicle performance. Sensitivity and response of the over all system in achieving a stabilized performance is a design choice as dictated by the performance parameters of the diaphragm mechanism in diaphragm control means 16 and in exhaust regulating means 6, as well as the resistance to flow provided by reduction means 19 and its associated passage means. The optium parameters may be empirically chosen according to principles well known to the art.

Figure 3:
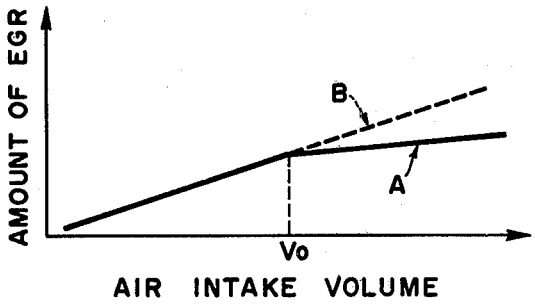
FIG. 3 is a graph which similarly illustrates the relationship between the volume of engine air intake and the volume of EGR as contrasted with prior art, conventional systems.
Figure 4:
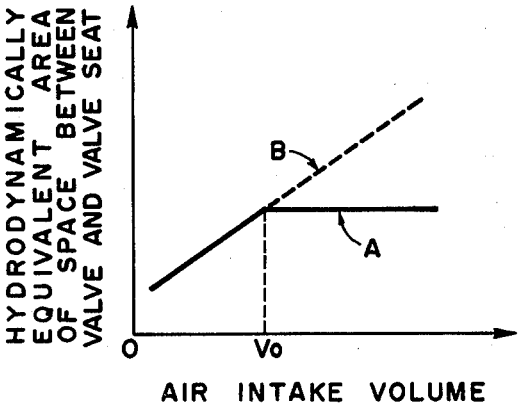
FIG. 4 is a graph which illustrates the relationship between the volume of engine air intake and the hydrodynamically equivalent area, expressed in arbitrary units, of the space between the valve and valve seat in the exhaust regulating means.

The actual performance of the present invention as empirically measured may be understood by viewing FIGS. 2 through 4. In FIG. 2, the ratio of EGR relative to the volume of engine air intake is empirically determined for the present invention as shown by solid line A. Performance of a conventional prior art system is shown for comparison by broken line B. It is to be noted that conventional exhaust gas recycling systems maintain a substantially constant EGR ratio as the volume of air intake of the internal combustion engine increases. In contrast, in the present invention, above a predetermined level, Vo the EGR ratio begins to be limited and decreases at an accelerating rate at all engine volume intakes above the predetermined level. This result is achieved by designing the above described system such that the effective hydrodynamic area of flow through reduction means 8 is greater than the maximum effective hydrodynamic area of flow between valve 11 and valve seat 9. Accordingly, the present invention is very effective in improving performance, decreasing fuel costs, and protecting the EGR control parts during periods of high power output of the engine.

Furthermore, in FIG. 3 the relationship between the volume of EGR and the volume of air intake is empirically shown for the present invention by solid line A. The performance of a conventional prior art system is shown for the sake of comparison by broken line B. It is to be noted that as air intake volume increases, the conventional system has a corresponding proportional increase in EGR. In contrast, the present invention is characterized by a decreased rate of EGR consumption above a limitin value, Vo, of air intake volume of the engine. Both FIGS. 2 and 3 indicate that for a system of the present invention, the EGR ratio decreases when the volume of the air intake exceeds a given level, and the volume of EGR increases only very slightly or only to an insignificant amount.

Table 1.

| Diameter of Open EGR Jet 8 mm | |
|---|---|
| Diameter of Reduction $D_2$ | Amount of $NO_x$ Emission g/km |
| 8 mm | 0.28 |
| 7.5 | 0.34 |
| 7.0 | 0.38 |
| 6.5 | 0.48 |
| 6.0 | 0.55 |

Table 2.

| Diameter of Reduction $D_2$ = 7 mm | |
|---|---|
| Diameter of Open EGR Jet | Amount of $NO_x$ Emission g/km |
| 10 mm | 0.70 |
| 9 | 0.65 |
| 8 | 0.70 |
| 7 | 0.80 |
| 6 | 0.68 |
| 5 | 0.70 |
| 4.5 | 0.75 |
| 4 | 0.85 |

Table 1 shows the empirical results obtained by the embodiment of the present invention when operated according to a standard operating condition for emission testing, Japanese Mode 10 operation. The right hand column of Table 1 shows the mass of NOx gas emitted in the exhaust gas of an internal combustion engine when the effective area of hydrodynamic flow between valve 11 and valve seat 9 of the present invention was made to correspond to that of a standard reduction having a diameter of 8 millimeters. The left hand column of Table 1 lists the inside diameter of a circular aperture defined by reduction means 8. It can be observed that as the inner diameter of reduction means 8 is decreased from 8 millimeters to 6 millimeters the amount of NOx gases approximately doubled.

Furthermore, Table 2 shows the empirical results obtained in testing the present invention in a standard mode 10 operation when the diameter of reduction means 8 was fixed at 7 millimeters and the effective area of hydrodynamic flow between valve 11 and valve seat 9 was varied between 10 square millimeters and 4 millimeters. It is to be noted that although the effective opening between valve 11 and valve seat 9 was more than doubled approximately only 20% change in the amount of NOx emissions was observed.

Although it is imperfectly understood, it can be empirically determined from the data listed in Tables 1 and 2 that the amount of NOx emission is substantially determined by the diameter of reduction means 8 in exhaust regulating means 6 and not by the relative opening or closing of valve 11. Therefore, according to the present invention, the volume of EGR may be varied without compromising or degrading the emission exhaust performance of an internal combustion when combined with the present invention. In addition, the amount of NOx emission may be reduced by appropriately selecting, by empirical means well known to the art, an appropriate diameter for the aperture of reduction means 8.

Finally, FIG. 4 illustrates the effective hydrodynamic area of flow between valve 11 and valve seat 9 as contrasted against the volume of air intake for the internal combustion engine. The performance of the present invention is empirically illustrated by solid line A and compared against the performance of conventional, prior art system by broken line B. It can be seen that when the volume of air intake exceeds a predetermined level, Vo the hydrodynamically equivalent effective area between valve 11 and valve seat 9 remains substantially constant in the present invention. In contrast, the effective hydrodynamic area of flow of conventional systems generally increases in a proportionate manner with intake volume. Thus, it may be readily appreciated that above a predetermined volume, Vo the overall performance of the present invention is exceptionally stable.

Although the present invention has been described and illustrated with respect to a single given embodiment operating entirely upon pneumatic principles while utilizing diaphragm mechanisms, it is to be expressly understood that many other embodiments and modifications may be possible and within the skill of an ordinary practioner in the art without departing from the spirit and scope of the present invention. It is to be expressly understood that the present invention may include any other mechanical, electrical, or fluidic control system well known to the art.

I claim:

1. An exhaust gas recycling system combined with an internal combustion engine having an air intake and exhaust manifold comprising:

exhaust regulating means coupled to said air intake and exhaust manifold for restricting the amount of exhaust gas recycled from said exhaust manifold to said air intake manifold and for controlling a ratio of recycled exhaust gas to air intake volume, said exhaust regulating means further including a valve means for restricting the amount of recycled gas when the air intake of said internal combustion engine increases above a predetermined magnitude such that the ratio of the amount of recycled exhaust gas to air intake volume decreases as the amount of air flow continues to increase after said valve is fully opened; and control means coupled to said exhaust regulating means communicating with at least one of said air intake and exhaust manifolds for controlling said exhaust regulating means.

2. The exhaust gas recycling system of claim 1 wherein said exhaust regulating means further includes a pressure chamber communicating with said exhaust manifold through first reduction means, said first reduction means for restricting the flow of exhaust gas from said exhaust manifold to said pressure chamber by restricting the effective area of hydrodynamic flow therebetween to a first value, and wherein said valve means restricts the flow of exhaust gas from said pressure chamber to said intake manifold to an effective area of hydrodynamic flow therebetween to a variable second value having a maximum magnitude less than said first value.

3. The exhaust gas recycling system of claim 2 wherein said diaphragm control means is coupled to said pressure chamber and includes a control valve means for increasing the magnitude of said second value of effective area of hydrodynamic flow of said valve means within said exhaust regulating means when said exhaust gas pressure within said exhaust manifold increases.

4. The exhaust gas recycling system of claim 3 wherein said valve means within said exhaust regulating means is a diaphragm actuated valve member engaging a valve seat, said valve member coupled to a diaphragm mechanism, coupled in turn to said intake manifold, the amount of partial pressure coupled between said intake manifold and diaphragm mechanism being controlled by said diaphragm control means.

5. The exhaust gas recycling system of claim 4 wherein said diaphragm control means is a diaphragm mechanism coupled to a valve to selectively bleed atmospheric pressure into said diaphragm mechanism of said exhaust regulating means in direct proportion to pressure within said pressure chamber at least within a predetermined range of intake air volumes.

6. An exhaust gas recycling system combined with an internal combustion engine having an intake and exhaust manifold comprising:

exhaust regulating means for restricting the flow of exhaust gas recycled from said exhaust manifold to said intake manifold comprising a pressure chamber, first reduction means coupled to said pressure chamber for restricting the flow of exhaust gas from a exhaust manifold through said first passage for transporting gas under pressure to said pressure chamber by restricting the effective area of flow therebetween to a first magnitude, a valve seat disposed adjacent to said pressure chamber, a first valve engaging said valve seat and restricting the flow of exhaust gas from said pressure chamber through said valve seat to said intake manifold through a second passage to an effective area of flow therebetween to a second magnitude having a maximum less than said first magnitude, a diaphragm mechanism having a master and slave chamber, and a diaphragm, said diaphragm coupled to said first valve, said slave chamber coupled to said second passage means, said first valve urged against said valve seat by a spring means, said master chamber communicating with second reduction means for restricting the flow of gas therethrough, said second reduction means communicating with said intake manifold; and diaphragm control means for controlling said first valve comprising a diaphragm mechanism having a master and slave chamber, and a diaphragm, said diaphragm coupled to a second valve, said master chamber communicating with said pressure chamber, said slave chamber vented to atmosphere and communicating through said second valve to said second reduction means, said second valve controlling the amount of atmospheric pressure bled into said second reduction means.

7. A method for controlling a ratio of recycled exhaust gas to air intake volume in an internal combustion engine having an air intake and exhaust manifold comprising the steps of:

controlling an exhaust regulating means by diaphragm control means communicating with said intake and exhaust manifolds, said diaphragm control means generating a pneumatic control signal in response to pressure in said intake and exhaust manifolds; and restricting the flow of recycled gas from said exhaust manifold through said exhaust regulating means to said intake manifold in response to said pneumatic control signal from said diaphram control means, said flow of exhaust gas in said exhaust regulating means being restricted by a first valve means and a pressure timer communicating with said exhaust manifold through a first reduction means, said first reduction means for restricting the flow of exhaust gas therethrough from said exhaust manifold by restricting the effective area of hydrodynamic flow through said first reduction means to a first magnitude, said first valve means communicating with said pressure chamber for restricting the flow of exhaust gas therethrough to said air intake manifold by restricting the effective area of hydrodynamic flow through said first valve means to a second magnitude having a maximum magnitude less than said first magnitude whereby the ratio of the amount of recycled exhaust gas to air intake volume decreases as the amount of air flow continues to increase above a predetermined magnitude after said first valve is fully opened.

8. The method of claim 7 wherein said pneumatic control signal is atmospheric pressure controllably bled into a line coupled between said intake manifold and exhaust regulating means.

9. The method of claim 8 wherein said atmospheric pressure bled into said line is controlled by second valve means coupled to a diaphragm mechanism movable in response to the pressure within said pressure chamber.

10. The method of claim 8 wherein said first valve means is coupled to a diaphragm mechanism movable in response to partial pressures communicated thereto from said intake manifold through second reduction means, said diaphragm control means communicating with said diaphragm mechanism through at least part of said second reduction means.

* * * * *